US007716013B2

(12) United States Patent
Orth et al.

(10) Patent No.: US 7,716,013 B2
(45) Date of Patent: May 11, 2010

(54) OUTDOOR GEAR PERFORMANCE AND TRIP MANAGEMENT SYSTEM

(75) Inventors: Maggie Orth, Seattle, WA (US); Sheila Kennedy, Boston, MA (US); Chris Verplaetse, San Francisco, CA (US); Brian Elginsmith, Oakland, CA (US)

(73) Assignee: The North Face Apparel Corp., Wilmington, DE (US)

( * ) Notice: Subject to any disclaimer, the term of this patent is extended or adjusted under 35 U.S.C. 154(b) by 0 days.

(21) Appl. No.: 11/846,164

(22) Filed: Aug. 28, 2007

(65) Prior Publication Data

US 2008/0142060 A1 Jun. 19, 2008

Related U.S. Application Data

(60) Provisional application No. 60/840,972, filed on Aug. 30, 2006, provisional application No. 60/889,883, filed on Feb. 14, 2007.

(51) Int. Cl.
*G06F 9/00* (2006.01)
*G06F 11/30* (2006.01)

(52) U.S. Cl. ..... 702/182; 702/131; 700/300; 219/211; 135/91

(58) Field of Classification Search ..... 135/91–94; 702/99, 104, 130, 131, 135, 136, 155, 158, 702/160; 700/299–300; 219/211–212
See application file for complete search history.

(56) References Cited

U.S. PATENT DOCUMENTS

D297,584 S 9/1988 Lenox et al.
D308,416 S 6/1990 Brumbach
5,023,430 A * 6/1991 Brekkestran et al. ..... 219/486
5,125,571 A 6/1992 Heber
5,217,408 A * 6/1993 Kaine ..... 454/338
D345,599 S 3/1994 Williams, Jr.
5,291,698 A * 3/1994 Rayner, Jr. ..... 52/3
5,344,361 A 9/1994 Matthias
5,425,620 A 6/1995 Stroud
5,561,862 A 10/1996 Flores, Sr.
5,564,124 A 10/1996 Elsherif et al.
5,605,144 A 2/1997 Simmons et al.
5,988,108 A 11/1999 Silver (Continued)

FOREIGN PATENT DOCUMENTS

GB 2 237 869 A 5/1991

*Primary Examiner*—Jeffrey R West
(74) *Attorney, Agent, or Firm*—Kenyon & Kenyon LLP

(57) ABSTRACT

Systems and methods of managing the performance of host products such as outdoor gear provide for detecting a connection between drive and performance modules. The performance module has an associated output type and is installed in a host product. A drive profile is selected from a plurality of drive profiles based on the output type and performance characteristic of the host product and is modified by controlling the performance module based on the selected drive profile. Other embodiments include systems and methods of managing trips provide for a performance unit that generates profile data for a performance module based on pre-trip data. The profile data instructs a drive module to modify a performance characteristic of a host product in which the performance module is installed. A trip management unit collects sensor data from a sensor based on the pre-trip data and generates post-trip data based on the sensor data.

20 Claims, 15 Drawing Sheets

U.S. PATENT DOCUMENTS 6,032,291 A 3/2000 Asenguah et al.
6,045,176 A 4/2000 Shoup
6,244,952 B1 6/2001 Arold et al.
6,382,208 B2 5/2002 Reedy et al.
6,386,414 B1 5/2002 Kilduff
6,397,869 B1 * 6/2002 Jennings ..... 135/93
6,461,290 B1 10/2002 Reichman et al.
6,727,197 B1 * 4/2004 Wilson et al. ..... 442/301
6,760,925 B1 7/2004 Maxwell
6,823,678 B1 * 11/2004 Li ..... 62/3.5
6,865,825 B2 * 3/2005 Bailey et al. ..... 36/88
6,970,092 B2 * 11/2005 Hum et al. ..... 340/573.4
7,007,861 B2 3/2006 Ketcha et al.
7,199,542 B1 * 4/2007 Chen ..... 318/473
7,307,541 B2 * 12/2007 Ikeda et al. ..... 340/815.4
2002/0082593 A1 * 6/2002 Hareyama et al. ..... 606/38
2003/0160063 A1 * 8/2003 Paukovits et al. ..... 222/129
2004/0139385 A1 * 7/2004 Sakaue ..... 715/500
2005/0033515 A1 * 2/2005 Bozzone ..... 701/214
2005/0034476 A1 2/2005 Pohr
2005/0060798 A1 3/2005 Diaz
2005/0151510 A1 7/2005 Bailey
2005/0164627 A1 7/2005 Boone, Jr.
2005/0197063 A1 * 9/2005 White ..... 455/41.2
2005/0246823 A1 11/2005 Groom
2005/0273143 A1 12/2005 Kanzius et al.
2006/0060576 A1 * 3/2006 Haas et al. ..... 219/543
2006/0291160 A1 * 12/2006 Freeman et al. ..... 361/687

* cited by examiner

OUTDOOR GEAR PERFORMANCE AND TRIP MANAGEMENT SYSTEM

CROSS-REFERENCE TO RELATED APPLICATIONS

This application claims the benefit of U.S. Provisional Application No. 60/840,972, filed Aug. 30, 2006, and U.S. Provisional Application No. 60/889,883, filed Feb. 14, 2007, the entire contents of which are hereby incorporated by reference.

BACKGROUND

1. Technical Field

Embodiments of the present invention generally relate to managing performance and trips of outdoor gear. More particularly, embodiments relate to outdoor gear performance and trip management systems having a high degree of adaptability and versatility.

2. Discussion

Outdoor gear such as backpacks, tents and jackets have been long in use by hikers and campers in a wide variety of circumstances and environmental extremes. For example, it is not uncommon for a mountain climber to experience extremely high body temperatures while climbing a surface (e.g., due to physical exertion), and extremely low ambient temperatures when the mountain peak or maximum elevation is reached. The clothing and/or equipment that the mountain climber is wearing, however, may prevent the climber from cooling down in the first instance, and may fail to adequately keep the climber warm in the second instance, or both.

While certain developments have been made to use electronics to adjust the performance characteristics of outdoor gear, a number of difficulties remain. For example, most heating solutions, such as heated jackets, involve a heating coil and control module that are permanently fixed to the jacket as well as to each other. As a result, the individual is typically required to purchase a highly customized heating solution for each type of host product for which greater warmth is desired. Similar challenges exist with regard to ventilation solutions (e.g., ventilated backpacks), illumination solutions (e.g., lighted tents), and so on.

It can also be difficult to conduct centralized trip planning tasks such as itinerary development and post-trip storytelling in a manner that is integral to the gear. Accordingly, the individual is often required to bring multiple logs, devices, etc. on the trip for navigation and documentation purposes.

DETAILED DESCRIPTION

Embodiments of the present invention provide improved adaptability, versatility and commonality in systems that control the performance characteristics of outdoor gear host products. In one embodiment, a connection between a drive module and a performance module is detected, wherein the performance module has an associated output type. A drive profile is selected from a plurality of drive profiles based on the output type of the performance module. The performance module is then controlled based on the selected drive profile to modify a performance characteristic of a host product in which the performance module is installed. Selection of the drive profile and control of the performance module can also be based on the type of host product in which the performance module is installed.

Figure 1:
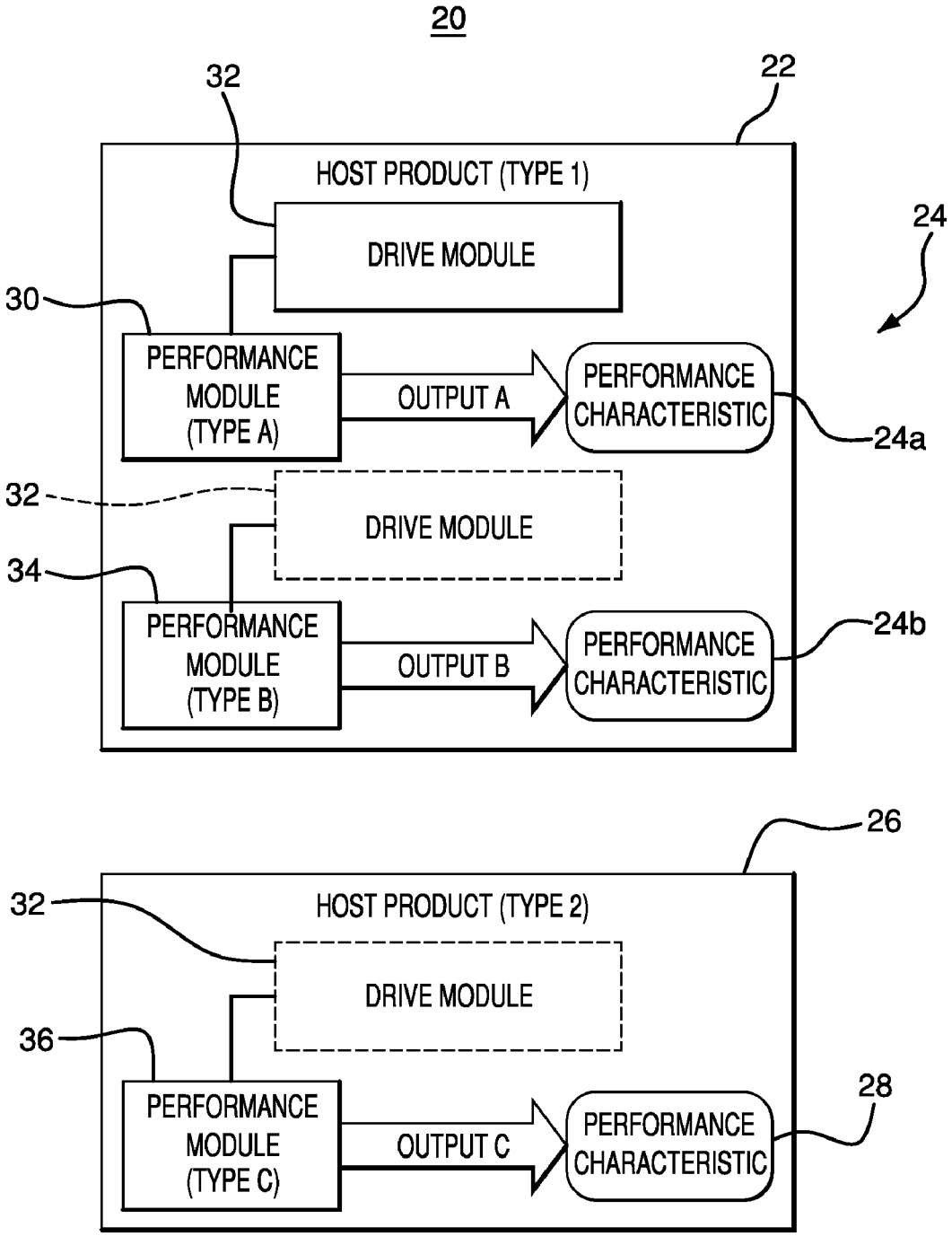
FIG. 1 is a block diagram of an example of an outdoor gear performance management system according to an embodiment of the invention.

Turning now to FIG. 1, an outdoor gear performance management system 20 is shown. In the illustrated example, a first host product 22, which is of a first type of host product ("Type 1"), has multiple performance characteristics 24 (24*a*, 24*b*) associated with it. As will be described in greater detail, the host products described herein may be any type of outdoor gear, such as clothing or equipment, and the performance characteristics 24 can be any type of parameter that reflects and/or defines the performance of the host product. For example, the performance characteristics 24 may include, but are not limited to, environmental parameters such as temperature, airflow and illumination. The illustrated outdoor gear performance management system 20 also includes a second host product 26, which is of a second type of host product ("Type 2"), with an associated performance characteristic 28.

In the illustrated example, the first host product 22 has a first performance module 30 of a certain type ("Type A") that generates a corresponding type of output ("Output A"), where the output of the first performance module 30 modifies the performance characteristic 24*a* of the host product 22. The first performance module 30 can be controlled by a drive module 32 based on a drive profile. The drive profile may be selected by the drive module 32 based on the type of output of the first performance module 30 as well as the type of host product 22 in which the first performance module 30 is installed. The drive profile may also be selected based on user input. By enabling the drive module 32 to adapt its behavior based on the performance module to which it is connected as well as the host product in which the performance module is installed, the outdoor gear performance management system 20 provides a much higher degree of adaptability, commonality, and/or modularity than conventional solutions.

For example, the drive module may be alternatively connected to a second performance module 34, of a second type ("Type B"), that has an output ("Output B"), wherein the output of the second performance module 34 impacts the performance characteristic at 24*b*. Thus, the drive module 32 may be used to control different types of performance modules. For example, the first performance module 30 might be a fan whose output increases the ventilation of the host product 22 (e.g., a backpack), and the second performance module 34 might be a light that is used to illuminate the host product 22 (e.g., a visible surface of the backpack). Indeed, a typical scenario might be one in which an individual uses the drive module 32 with the first performance module 30 when hiking during the day to ventilate a back surface of a backpack in warm conditions (according to one drive profile), and use the drive module 32 with the second performance module 34 when hiking at night to illuminate the front of the backpack for visibility and safety concerns (according to another drive profile). The drive profile for the backpack ventilation usage model could, for example, provide a current/voltage signature that uses a certain range of drive currents or voltages suitable for operating a fan. Similarly, the drive profile for the safety illumination usage model could, for example, provide a current/voltage signature that causes a light emitting diode (LED) of the second performance module to flash. As will be discussed in greater detail, drive profiles may also be selected based on user input. This high degree of flexibility is facilitated by the ability of the drive module 32 to detect both the type of performance module to which it is attached as well as the type of host product in which the performance module is installed.

The drive module 32 may also be used in the second host product 26 along with a third performance module 36, of the "Type C", wherein the third performance module 36 has an output ("Output C") that affects a performance characteristic 28 of the second host product 26. For example, the performance module 36 could be a heating pad and/or coil that is installed in a jacket. In such a case, the drive module 32 would be able to determine both that the third performance module 36 is a heating pad and that the second host product 26 is a jacket. Accordingly, the drive module 32 may use this information to select a drive profile that provides the appropriate current/voltage signature to control the third performance module 36 as a heating pad.

Figure 2:
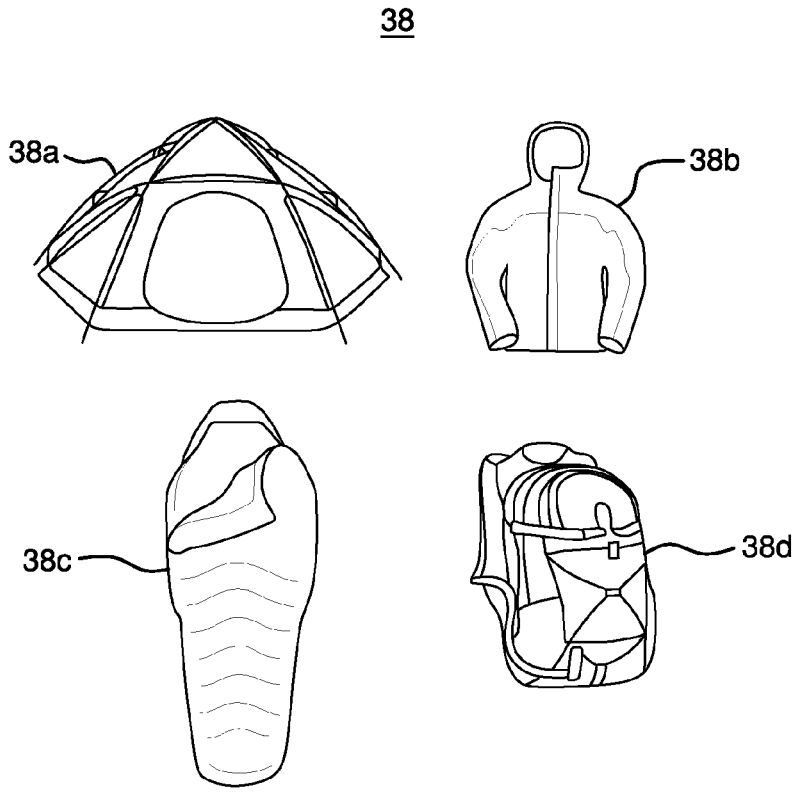
FIG. 2 is an illustration of an example of a plurality of types of host products according to an embodiment of the invention.

Turning now to FIG. 2, an ecosystem of example host products (38*a*-38*d*) is shown. In particular, host products may include clothing, such as jacket 38*b* and footwear (not shown), as well as equipment, such as tent 38*a*, sleeping bag 38*c* and backpack 38*d*. Other types of outdoor gear, such as gloves, hats, etc. may also be used with the performance management systems described herein. Each host product 38 can be designed to be compatible with one or more performance modules, so that the performance modules may be readily installed in and removed from the host products 38. For example, the tent 38*a* may include a pouch or sleeve to hold the LED and wiring of an illumination performance module, as well as a pouch or pocket to hold a drive module to be connected to the performance module. If the performance module is mounted externally to the tent 38*a*, the tent 38*a* may also include a window adjacent to the LED of the illumination performance module to permit light from the LED to enter the tent 38*a*. As another example, the back surface of the backpack 38*d* may be equipped with channels that are attached to the output of a compartment containing a fan of a ventilation performance module. The backpack 38*d* may also include a pouch or pocket to hold a drive module to be connected to the performance module. A wide variety of other attachment mechanisms may be used to couple the host products with the performance modules.

Figure 3:
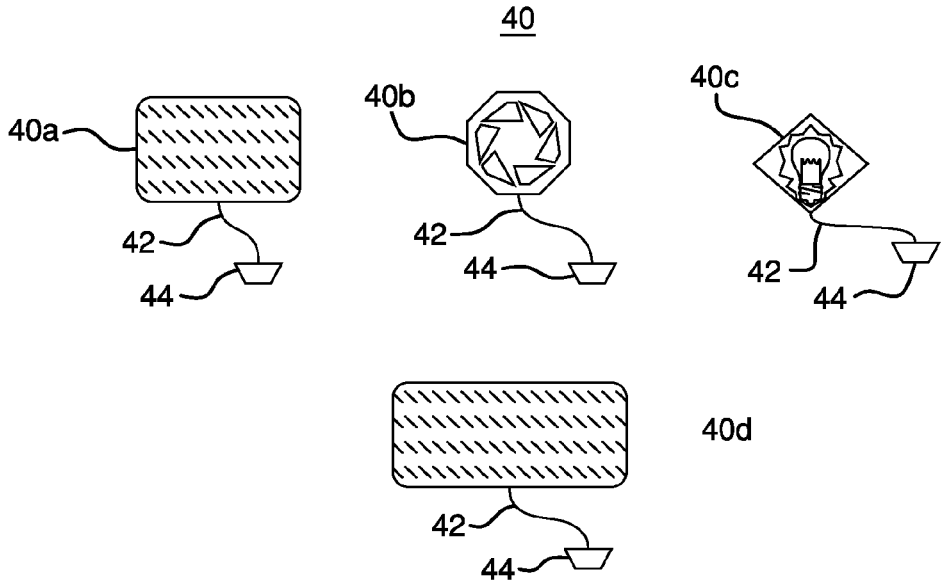
FIG. 3 is a diagram of an example of a plurality of types of performance modules according to an embodiment of the invention.

FIG. 3 shows a plurality of types of performance modules 40 (40*a*-40*d*). The performance modules 40 may be substituted for any of the performance modules 30, 34, 36 (FIG. 1) already discussed. In particular, performance module 40*a* is a small heating pad, performance module 40*b* is a fan, performance module 40*c* is a light, and performance module 40*d* is a large heating pad. Accordingly, the heating pad performance module 40*a* and 40*d* may be used to modulate the temperature of the host product in which they are installed, the fan performance module 40*b* may be used to modulate the air flow and/or ventilation of the host product in which it is installed and the light performance module 40*c* may be used to modulate the illumination of the host product in which it is installed. Each of the performance modules 40 can be installed in any of the host products, such as host products 38 (FIG. 2), as appropriate.

For example, with continuing to reference to FIGS. 2 and 3, the light performance module 40*c* may be installed in the tent 38*a* to illuminate the interior of the tent (e.g., as a reading light), on the back of the jacket 38*b* to illuminate the back surface of the jacket 38*b* (e.g., for safety concerns), on a sleeve of the jacket 38*b* (e.g., as a reading light), or on the front surface of the backpack 38*d* (e.g., for safety concerns). Similarly, it might be desirable to use the fan performance module 40*b* to ventilate the tent 38*a*, the jacket 38*b*, or the backpack 38*d*. The small heating pad performance module 40*a* may be used to increase the temperature of a relatively small host product such as the lower back portion of the jacket 38*b* or a glove (not shown), and the large heating pad performance module 40*d* may be used to increase the temperature of a relatively large host product such as the sleeping bag 38*c*. Other variations on the placement of the performance modules 40 within the host products 38 may be made without parting from the spirit and scope of the embodiments described herein. Each of the performance modules 40 may also include a wire pair (or "tether") 42, which provides an electrical connection to a connector 44. Thus, each of the illustrated performance modules 40 has a common interface to the drive module, wherein the same drive module can be used to control each of the performance modules 40. In this regard, the drive module can be considered a "body" and the performance modules 40 can be considered a plurality of interchangeable "heads".

Figure 4A:
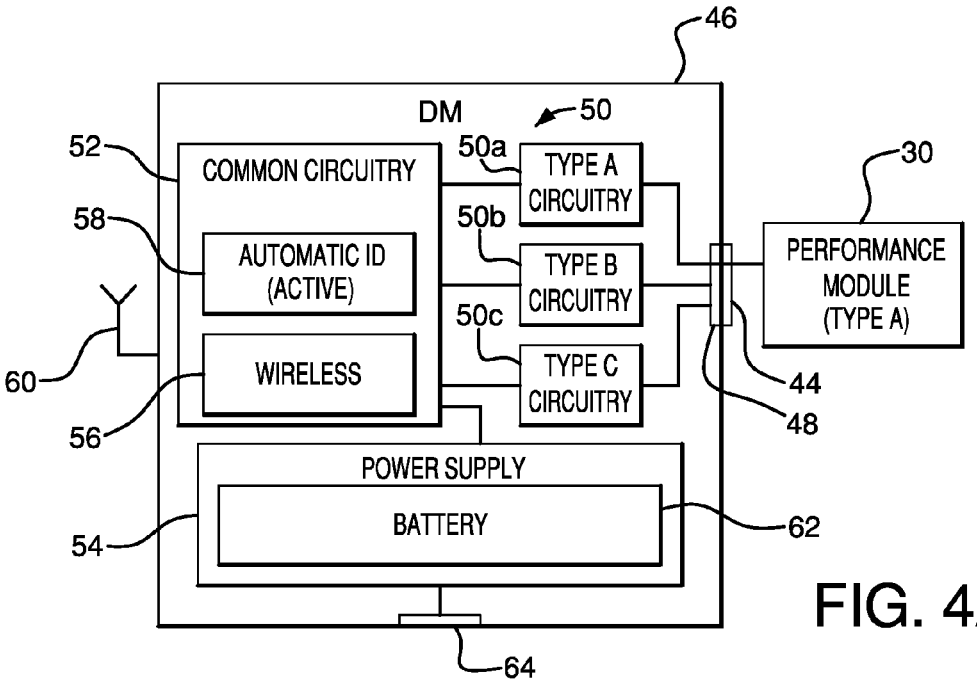
FIG. 4A is a diagram of an example of a drive module according to an embodiment of the invention.

Turning now to FIG. 4A, one embodiment of a drive module ("DM") 46 is shown. The drive module 46 may be substituted for the drive module 32 (FIG. 1) already discussed. In the illustrated example, the drive module 46 has a connector 48 that interfaces with the connector 44 of performance module 30. In one embodiment, the connector 48 may have a pin assigned to each type of performance module (as well as a ground/reference pin), wherein mating the connector 48 of the drive module 46 with the connector 44 of the performance module 30 enables the drive module 46 to determine the type of performance module 30 to which it is attached. In another embodiment, a data bus may be provided in which the performance module 30 transmits its type as well as other information, such as a drive profile and user interface information (e.g., icons), over the data bus to the drive module 46. Other variations of interfacing the performance module 30 with the drive module 46 can also be used.

The drive module 46 may have a plurality of performance module type-specific circuits 50 (50*a*-50*c*) as well as common circuitry 52 and a power supply 54. The illustrated performance module type-specific circuits 50 are coupled to the appropriate output pins of the connector 48 in order to achieve the desired level of control customization. The common circuitry 52 may include a wireless unit 56 such as a radio frequency (RF) unit, and an active automatic identification system 58 such as an RF identification (RFID) reader, as well as other circuitry required to select drive profiles, identify host products, communicate with other devices via an antenna 60 and control the performance modules. The wireless unit 56 can use a wide variety of communication techniques such as infrared (IR) communication, personal area networking, and intra body communication, and can operate in accordance with any number of appropriate protocols such as Bluetooth (e.g., Bluetooth Core Specification Version 2.0), WIFI (e.g., Institute of Electrical and Electronic Engineers/IEEE 802.11 Standards), etc. Examples of the automatic identification system 58 include, but are not limited to, barcodes, electronic article surveillance tag systems, chipless RFID and other vision based tagging systems. The wireless communications and automatic identification functionality of the drive module 46 will be described in greater detail below. In addition, the common circuitry 52 may include circuitry for sensing (e.g., body temperature, heart rate), tracking (e.g., Global Positioning System/GPS), trip data collection/reporting/analysis, and entertainment (e.g., media playing). Aspects of this additional functionality are described in greater detail below.

In the illustrated example, the power supply 54 includes a single battery 62, which may be a lithium ion battery or other renewable power source such as a fuel cell. The power supply 54 is also coupled to a charging port 64, which enables the battery 62 to be charged from an external source such as an alternating current (AC) 110 volt source, a mobile twelve volt source, a solar panel, mechanical energy harnessing and conversion system, and so on. The drive module 46 may also be operated directly from any of these external sources. In particular, the use of a solar panel to power the drive module 46 may be highly desirable, as will be described in greater detail below.

Figure 4B:
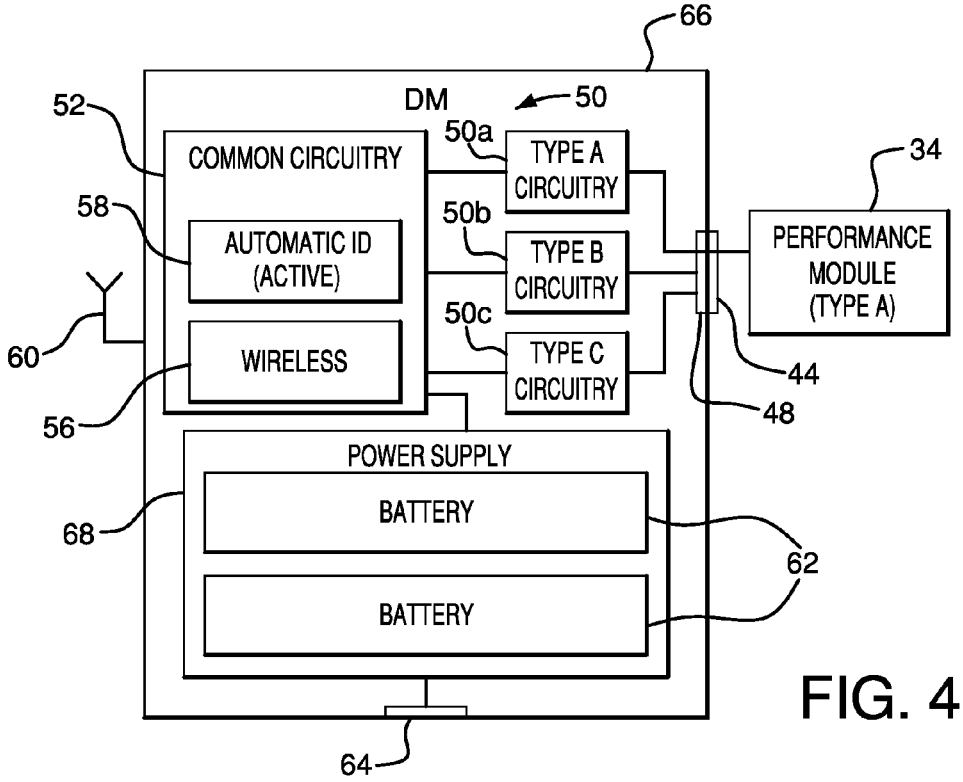
FIG. 4B is a block diagram of an example of a drive module according to an alternative embodiment of the invention.

FIG. 4B shows an alternative "high power" drive module ("DM") 66 having a power supply 68 with two batteries 62. The illustrated batteries are identical and interchangeable across drive modules. This example may be useful in the case of a large heating pad 40*d* (FIG. 4B), which may draw substantially more current than a small heating pad, as a performance module. The remaining functionality of the drive module 66 is similar to that of the drive module 46 (FIG. 4A) and drive module 32 (FIG. 1), already discussed.

Figure 5A:
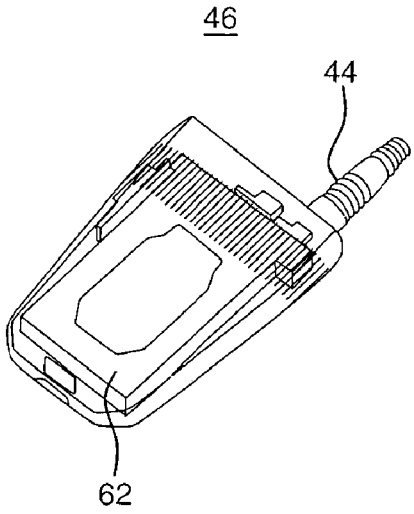
FIG. 5A is an illustration of an example of a drive module according to an embodiment of the invention.
Figure 5B:
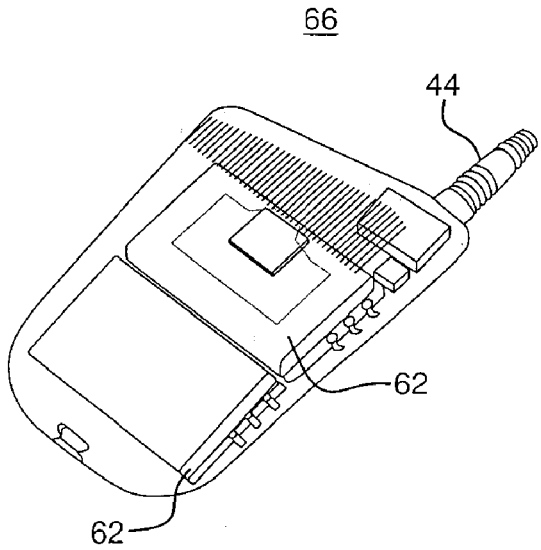
FIG. 5B is an illustration of an example of a drive module according to an alternative embodiment of the invention.

FIG. 5A shows an example of a drive module 46 having a single battery 62 as discussed above. The illustrated drive module 46 is coupled to a rugged connector 44 of a performance module (not shown). FIG. 5B shows an alternative drive module 66 having two batteries 62 and a larger form factor. In drive module 66 may be used to power and control a large heating pad as already discussed.

Figure 6A:
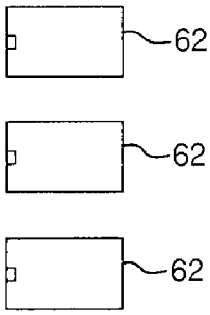
FIGS. 6A-6C are diagrams of examples of power sources according to embodiments of the inventions.
Figure 6B:
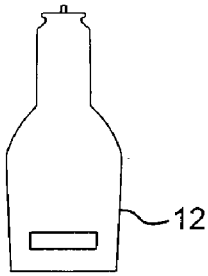
Figure 6C:
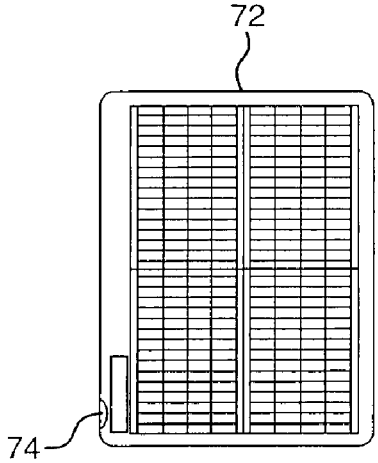

FIGS. 6A-6C illustrate the interchangeability of the power sources for the drive modules. In particular, FIG. 6A shows a plurality of identical batteries 62, which may be installed in either the small drive module or the large drive module depending on current and/or power needs. FIG. 6B illustrates a mobile 12 volt charger (i.e., a car charger), which may be used to charge the batteries 62 or power the drive module. FIG. 6C illustrates yet another example in which a solar panel 72 is used to charge the batteries 62 and/or power the drive module. The illustrated solar panel has a standard universal serial bus (USB) port 74 that is able to connect to a cable (not shown) having a USB connector at one end and a connector that is able to plug into the charge port 64 (FIGS. 4A and 4B) of the drive module at the other end.

Figure 7:
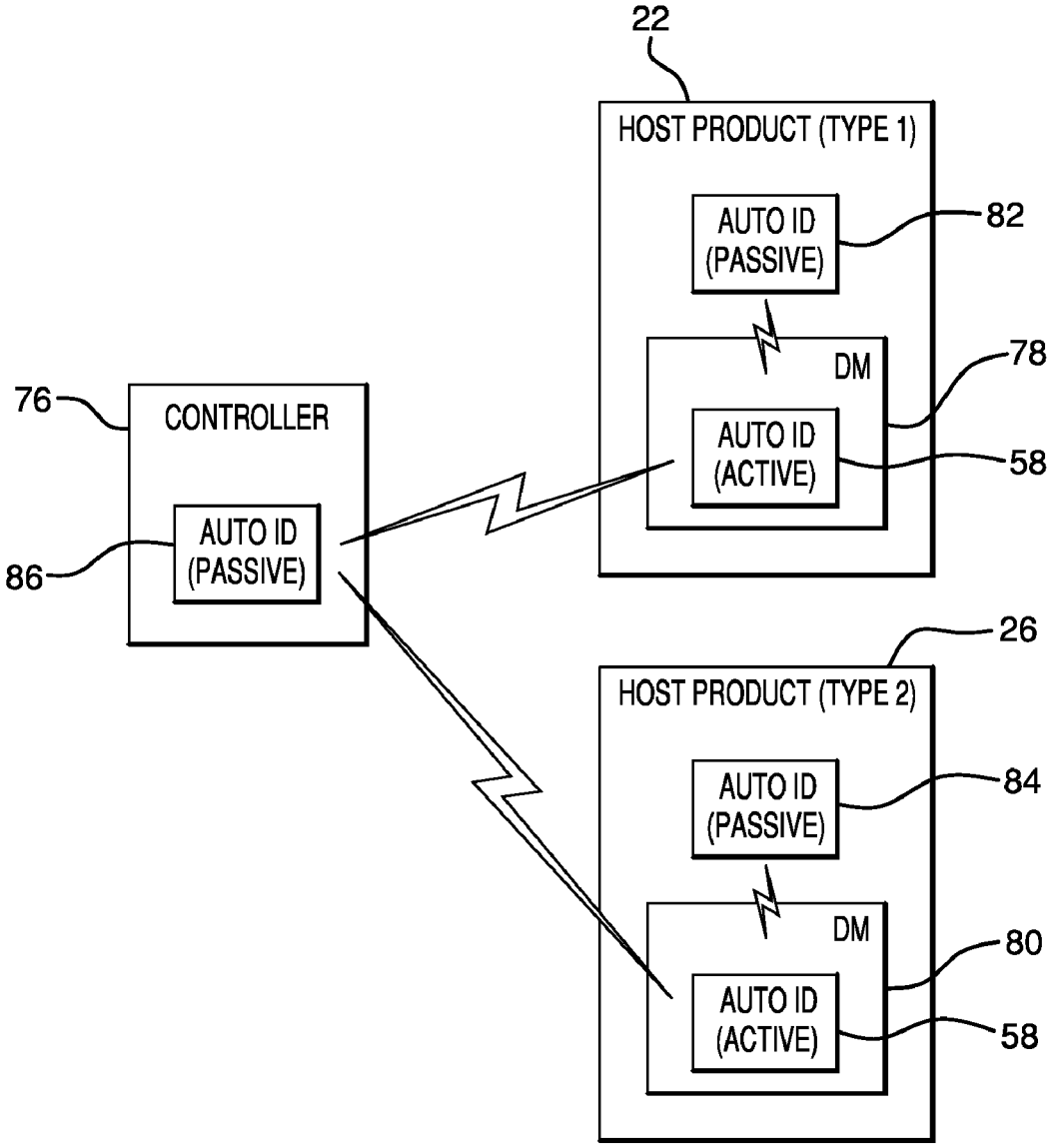
FIG. 7 is a block diagram of an example of a radio frequency (RF) identification and communication scheme according to an embodiment of the invention.

Turning now to FIG. 7, a controller 76 (or "netswitch", "key", etc.) is shown, wherein the controller 76 may be used by an individual to remotely control drive modules and their corresponding performance modules. The illustrated example, the first host product 22 has a first drive module 78 and a second host product 26 has a second drive module 80. Each illustrated drive module 78, 80 has an active automatic identification ("Auto ID") system 58 that is able to identify host products and controllers based on their passive automatic identification ("Auto ID") components. In particular, the first host product 22 can have a first passive auto ID component 82 that identifies the host product 22 by type. For example, the first passive auto ID component 82 might identify the host product 22 as a backpack, or a particular type of backpack. Thus, when the drive module 78 is installed in the first host product 22 (e.g., by sliding it into an associated pouch or pocket), the active auto ID system 58 of the first drive module 78 can read the first passive auto ID component 82, which is positioned within the read range of the active auto ID system 58, and identify the first host product 22. Similarly, the second host product 26 includes a second passive auto ID component 84, which can be read by the active auto ID system 58 of the second drive module 80, to identify the second host product 26 by product type. The active/passive nature of the host identification system may be reversed such that the host products 22, 26 contain an active auto ID system 58 and the drive module 78 contains the passive auto ID component 82. In one example, the active auto ID system 58 is an RFID reader and the passive auto ID components 82, 84 are RFID tags.

Each of the drive modules 78, 80 can also identify the presence of the controller 76 by virtue of a passive auto ID component 86 that is associated with the controller 76. For example, the first drive module 78 could "register" the controller 76 when the controller 76 is brought within the appropriate read range of the active auto ID system 58 in the first drive module 78. Once the first drive module 78 has identified the controller 76, the identity of the first host product 22, as well as the type of performance module (not shown) to which the drive module 78 is attached may be wirelessly communicated back to the controller 76 using wireless communication electronics already discussed. Similarly, the second drive module 80 may register the controller 76 and wirelessly communicate the contents of the second passive auto ID component 84 (identifying the host product) as well as an indication of the type of performance module to which the second drive module 80 is attached, back to the controller 76. With the information from the drive modules 78, 80, the controller 76 can enable the individual to select settings and/or performance characteristics for multiple host products and/or performance modules as desired. In this regard, the number of host products 22, 26 may be greater or less than the number shown. Similarly, the number of drive modules 78, 80 (and associated performance modules) within each host product and across host products may be greater than or less than the number shown. As a result, the illustrated outdoor gear performance management system is highly customizable.

Once the controller 76 has registered with the various drive modules 78, 80 in the ecosystem, the drive modules 78, 80 can wirelessly transmit information regarding performance module identification, drive module settings, host product identification, battery life, etc., back to the controller. The controller 76 can use this information to enable the individual to select operational settings for the performance modules. These settings may be transmitted to the drive modules 78, 80 as control signals. The drive modules 78, 80 use these control signals to select drive profiles and control the performance modules accordingly.

In addition to managing the performance characteristics of the host products 22, 26, the drive modules 78, 80 may also function as sensing and/or tracking modules. In such a case, other types of information such as sensor information (e.g., body temperature, heart rate, hydration, motion, ambient temperature, compass/heading, weather forecast), and tracking information (e.g., Global Positioning System/GPS, location/local presence, speed, altitude, distance, pace, calories burned, humidity, barometer pressure, clock, stopwatch, date, alarms) may also be wirelessly exchanged between the controller 76 and the drive modules 78, 80. The drive modules 78, 80 may additionally communicate with the controller 76 regarding data collection/reporting/analysis information such as "pre-trip" data (e.g., route guide, estimated route time, map, elevation, distance, weather forecast, gear lists, geography/topography) and "post-trip" data (e.g., trip log, route, actual route time, map, elevation, distance, experienced weather conditions, speed, heart rate, body temperature). In addition, the drive modules 78, 80 may also function as communication devices (e.g., enabling communication between individuals, between trip and "service", and for safety) and as entertainment devices (e.g., media playing/recording, computing, games).

Figure 8:
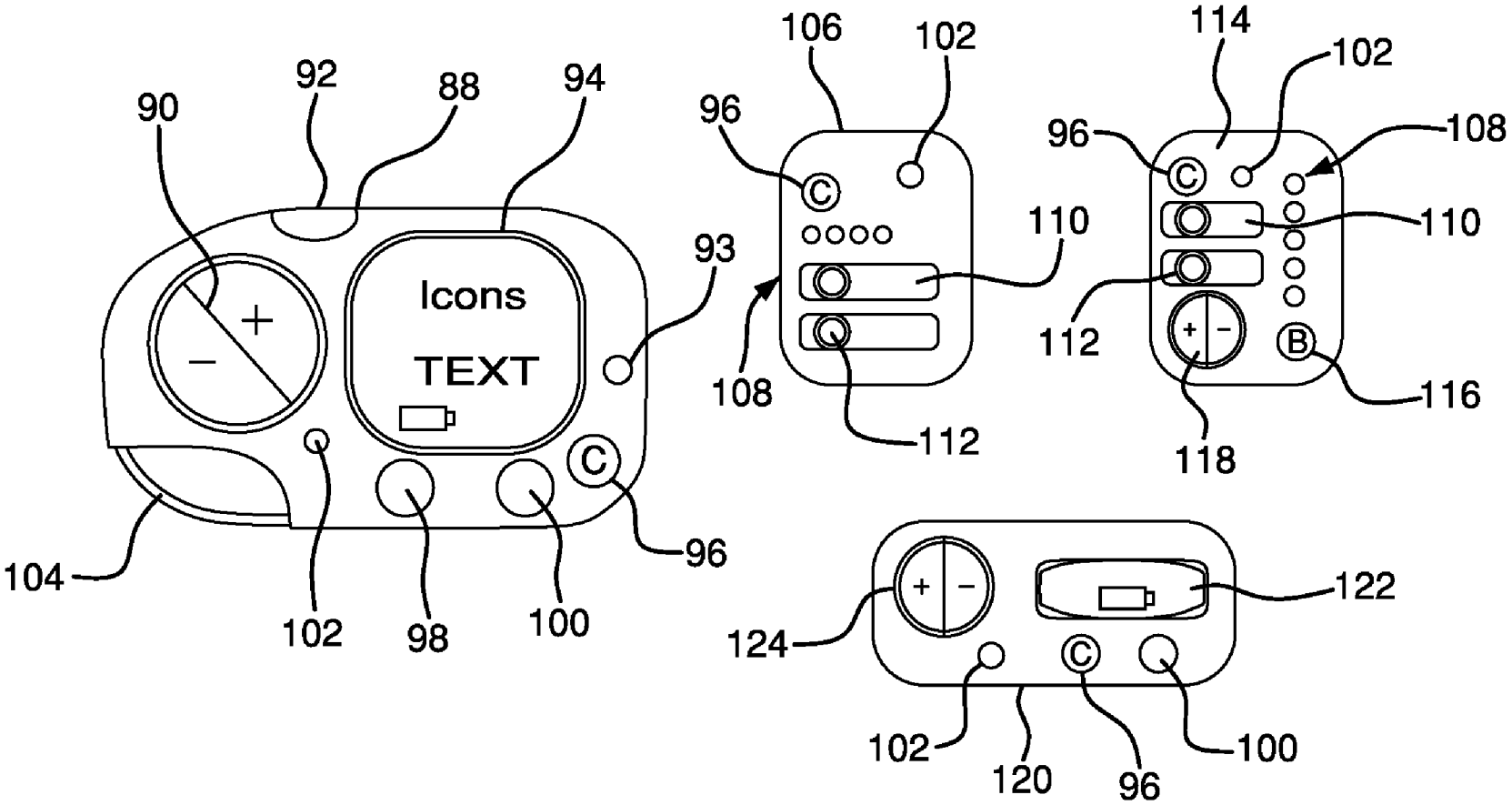
FIG. 8 is a diagram of multiple examples of controller configurations and multiple examples of drive module configurations according to embodiments of the invention.

FIG. 8 shows a plurality of alternative configurations for the above-described controller and drive module. For example, the left-most illustration of a controller 88 has a soft control level adjust button 90, which enables the user to make "up" or "down" selections, or "high, medium, low" selections for the performance modules. Other types of selections that might be made with the adjust button 90 are "no melt" and "auto" selection. A power button 92 enables the user to power the controller 88 on and off, and lock the controller 88. A display 94 includes appropriate icons, text and battery life information to inform the user as to the status of the outdoor gear performance management system. A back light button 93 enables the user to activate a back light for the display 94 in poorly lit environments. A connect button 96 may be used to associate the controller 88 with any drive modules that may be in the ecosystem. Thus, pressing the connect button 96 may cause the controller 88 to signal the nearby device modules to read the RFID tag 86 (FIG. 7) within the controller 88. Function buttons 98, 100 can be used to assign performance modules to groups, select groups of performance modules, define modes of operation for groups, and select other mode specific options. For example, similar types of performance modules, such as heating pads, may be assigned to a group and controlled together. The same may be true for other types of modules and subsets of the same type of module. Function button 98, 100 may also be used to select other functions of the controller such as turning button sounds off. An LED 102 may also be provided on the controller 88 to communicate status information to the user. In the illustrated example, a mechanical clip-on attachment system 104 may be used to attach the controller 88 to garments and/or equipment.

The bottom-right illustration shows another configuration of a controller 120 that has a smaller display 122 that is used only to relay battery life information. The illustrated controller 120 also has a level adjust button 124. Either of the illustrated controllers 88, 120 may be substituted for the controller 76 (FIG. 7), already discussed.

The upper-right illustrations show examples of drive module user interfaces. In particular one embodiment of a drive module 106 uses a simplified battery gauge display 108. The drive module 106 may also have a connect button 96, which can be used to signal the drive module 106 to register a nearby controller. In addition, a group assignment button 110 and level adjust button 112 are provided.

Yet another example of a drive module 114 is shown in which a battery gauge button 116 enables the user to selectively check the battery status of the drive module and a smaller soft control level adjust button 118 is provided. Either of the illustrated drive modules 106, 114 may be substituted for the drive modules 32 (FIG. 1), 46, 66 (FIGS. 4A & 4B), 78, 80 (FIG. 7), already discussed.

Figure 9:
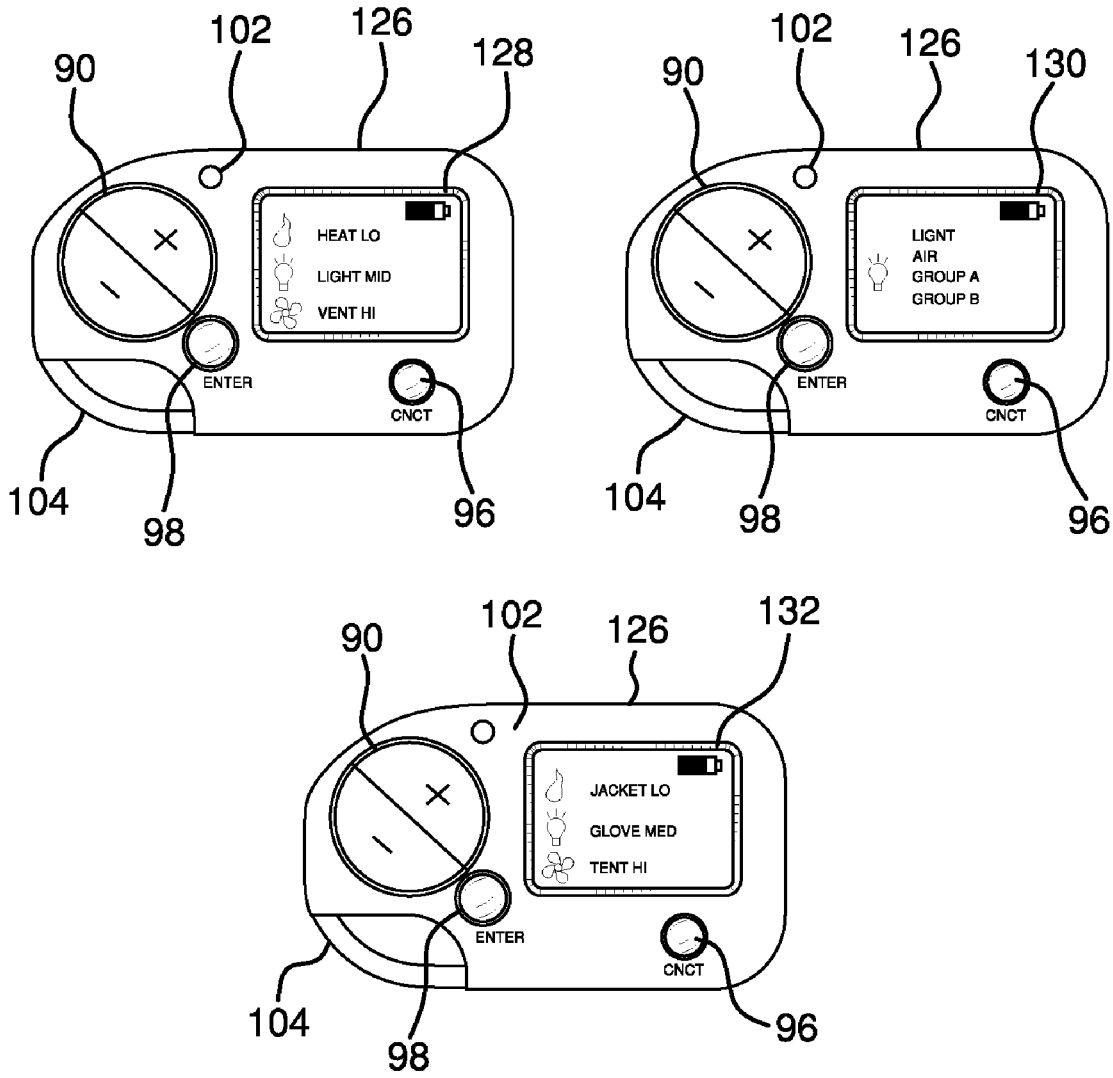
FIG. 9 is a diagram of multiple example of controller display outputs according to embodiments of the invention.

Turning now to FIG. 9, various screen display outputs are shown for a controller 126. In this example, a display output 128 communicates to the user that a heating performance module is set to a low setting, a light performance module is set to a medium setting and a ventilation performance module is set to a high setting. The display output 128 also relays battery life information. Another display output 130 communicates the light setting for groups of performance modules, as well as battery life information. In yet another display output 132, the user can determine that a heating performance module installed in a jacket is set to a low setting, a heating performance module installed in a glove is set to a medium setting and a ventilation performance module installed in a tent is set to a high setting. In other words, host product information may also be relayed via the controller display. Again, the battery life is also displayed. The illustrated controller 126 may be substituted for the controller 76 (FIG. 7), already discussed.

Figure 10:
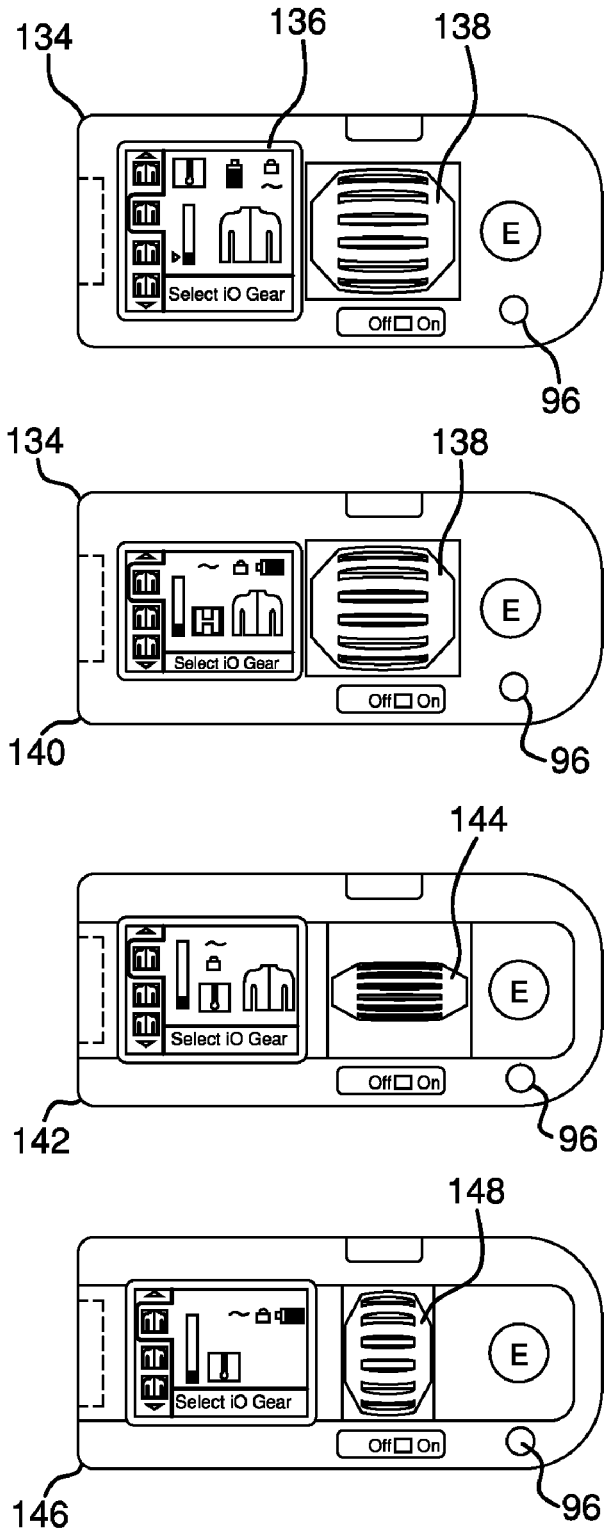
FIG. 10 is a diagram of multiple examples of controller vertical scrolling configurations according to embodiments of the invention.
Figure 11:
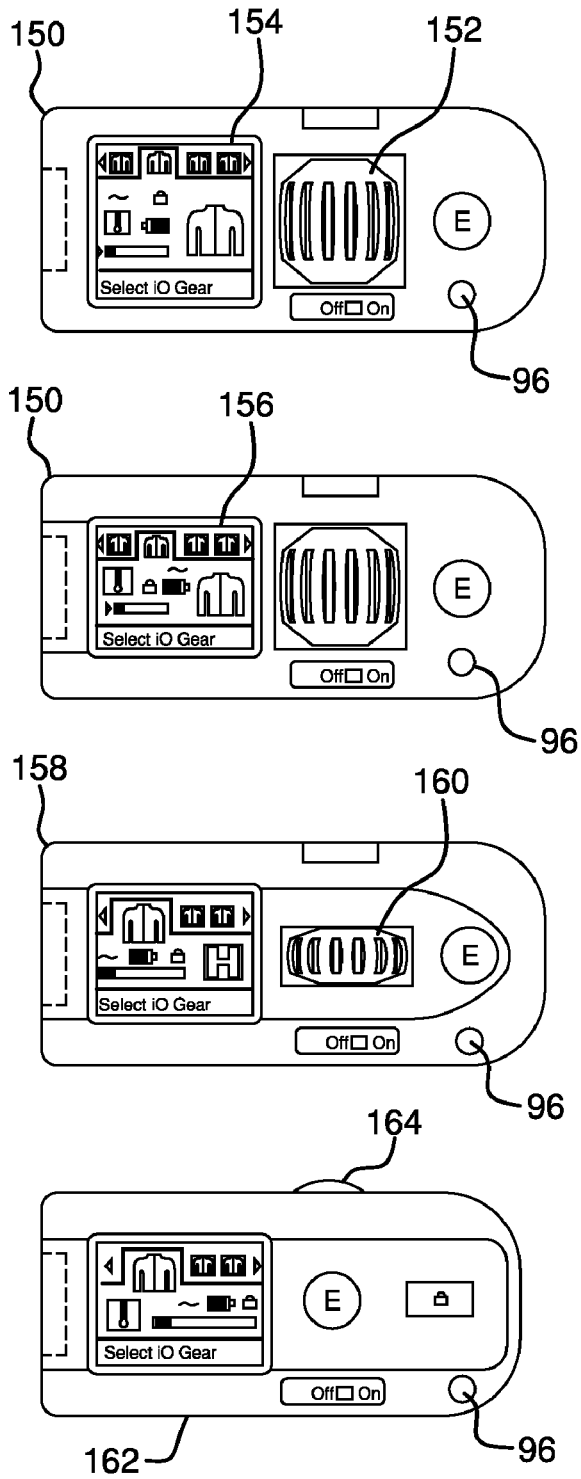
FIG. 11 is a diagram of multiple examples of controller horizontal scrolling configurations according to embodiments of the invention.

FIGS. 10 and 11 demonstrate various scrolling mechanisms that can also be provided on the controller. In particular, FIG. 10 shows a vertical scrolling arrangement for a controller 134. In particular, a scrolling wheel 138 is provided on the controller 134. A first display output 136 provides a first set of information to the user and a second display output 140 provides a second set of information to the user as the wheel 138 is rotated. An alternative controller 142 has a scrolling wheel 144 that is smaller in the vertical dimension, whereas a controller 146 has a scrolling wheel 148 that is smaller in the horizontal dimension.

FIG. 11 shows various controller configurations with horizontal scrolling wheels. In particular, a controller 150 has a scrolling wheel 152 that enables the user to access information on display output 154 as well as display output 156. An alternative controller 158 has a horizontal scrolling wheel 160 that is smaller in the vertical dimension. And yet another example, a controller 162 has an edge-mounted scrolling wheel 164.

Figure 12:
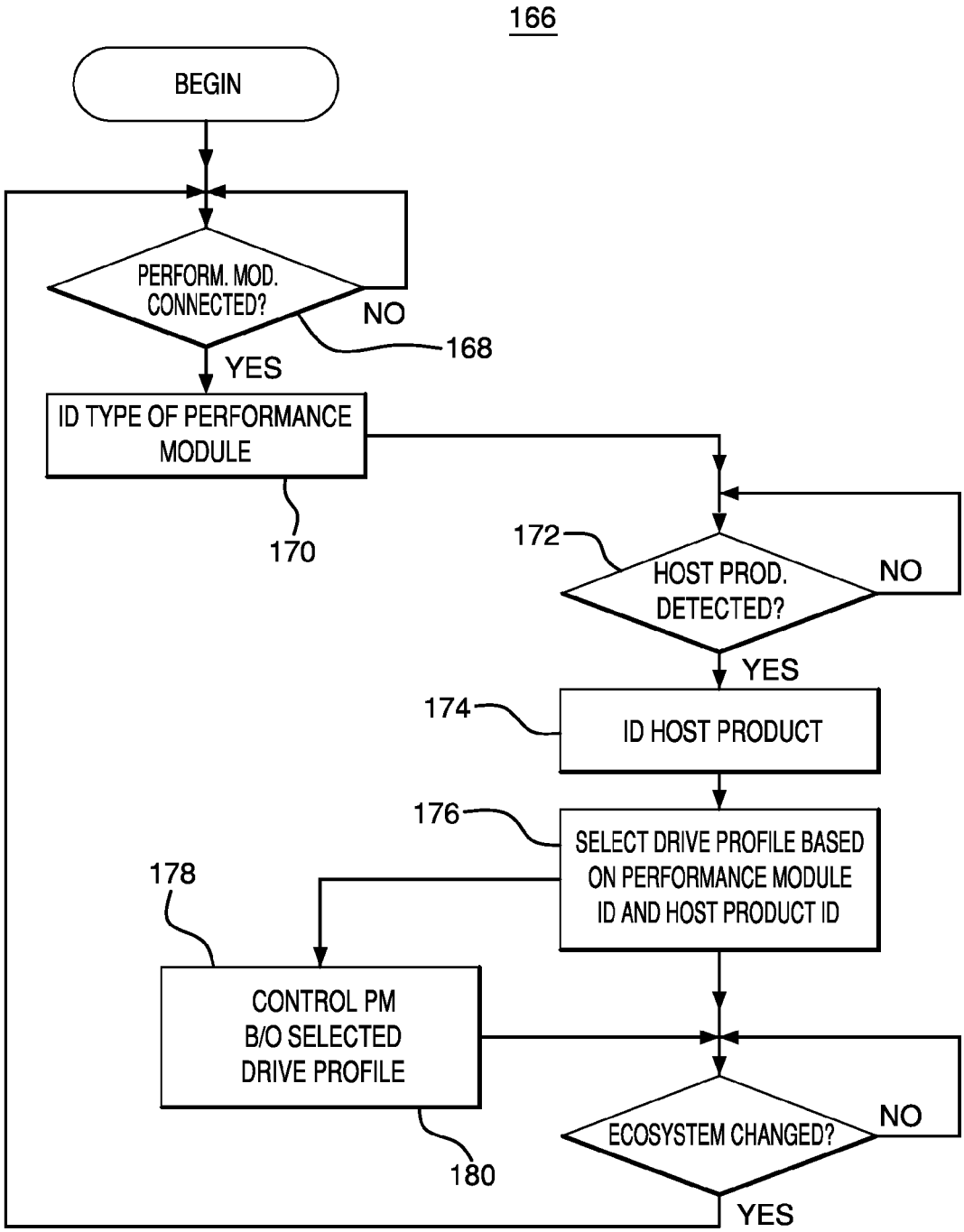
FIG. 12 is a flowchart of an example of a method of operating a drive module according to an embodiment of the invention.

Turning now to FIG. 12, a method 166 of operating a drive module is shown. The method 166 may be implemented in hardware, software, firmware, etc., and any combination thereof. For example, the method 166 may be stored as a set of instructions in a machine readable medium such as read only memory (ROM), random access memory (RAM), flash memory, etc., wherein the instructions are capable of being executed by a processor. The method 166 may also be incorporated as fixed functionality hardware in an application specific integrated circuit (ASIC), a processor, or a microcontroller, using techniques such as complimentary metal oxide semiconductor (CMOS) technology, transistor-transistor logic (TTL), and so on.

In the illustrated method, processor block 168 provides for determining whether a performance module has been connected to the drive module. As already discussed, this function may be implemented by detecting a signal presence on a particular pin of a connector between the drive module and the performance module. If such a presence is detected, the type of performance module is identified at block 170 and the determination is made at block 172 as to whether a host product has been detected. Upon detection of a host product, block 174 provides for identifying the host product (using, e.g., RFID technology) and block 176 provides for selecting a drive profile based on the performance module ID and/or the host product ID. The performance module is controlled based on the selected drive profile at block 178 and a determination is made at block 180 as to whether the ecosystem has changed. Ecosystem changes may include, but are not limited to, the performance module being disconnected from the drive module, the performance module being installed into a different host product, etc. If such a change is detected, the method 166 returns to the beginning of the routine at block 168.

Figure 13:
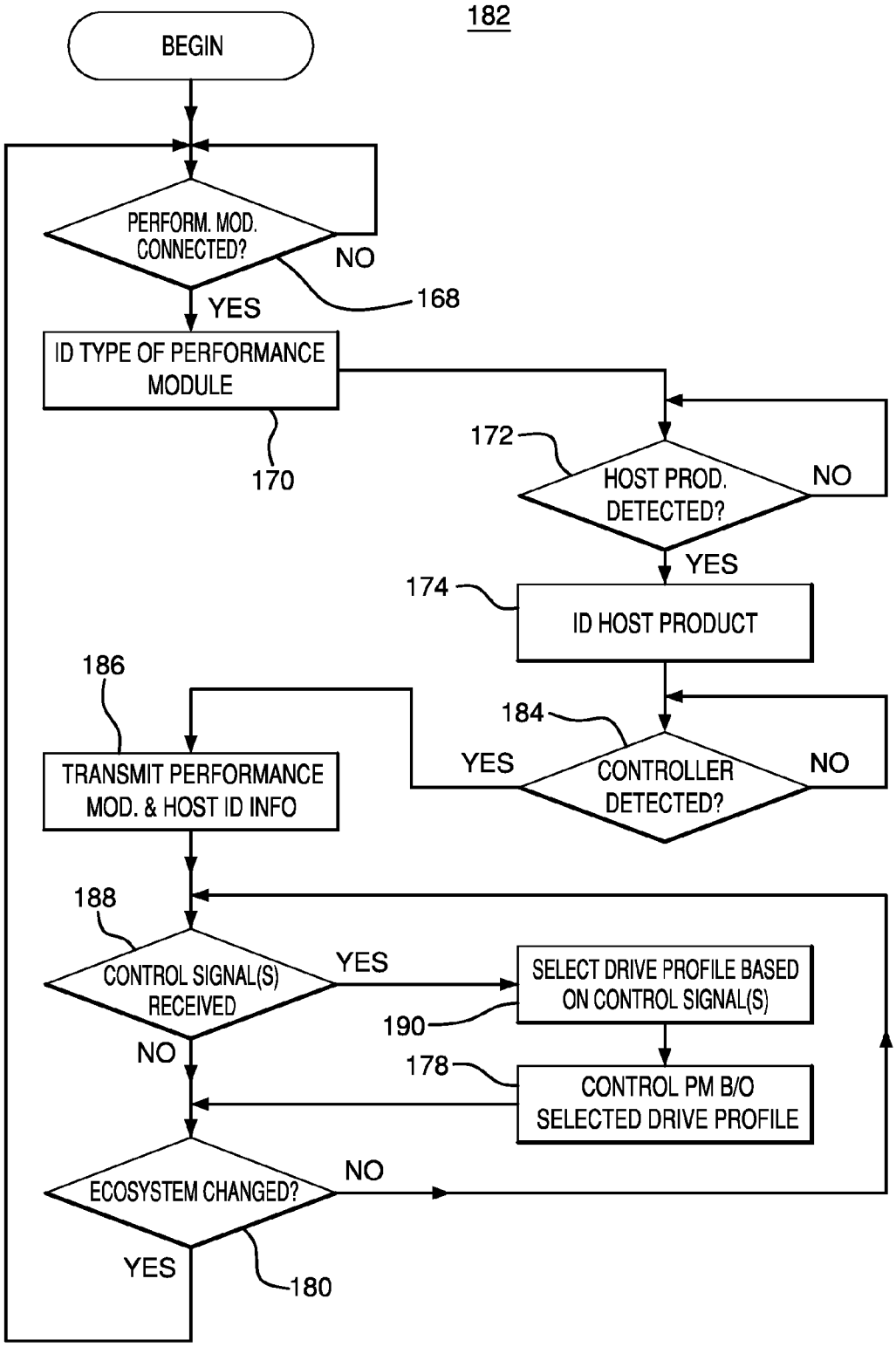
FIG. 13 is a flowchart of an example of a method of controlling a drive module according to an alternative embodiment of the invention.

FIG. 13 shows an alternative method 182 of operating a drive module in which the drive module may also communicate with a controller. In particular, processing block 168 provides for determining whether a performance module has been connected to the drive module. If so, the type of performance module is identified at block 170 and a determination is made at block 172 as to whether a host product has been detected. Upon detection of a host product, block 174 provides for identifying the host product. As already discussed, this block may involve the use of RFID technology. Block 184 provides for determining whether a controller has been detected. An affirmative determination at this block could result from the individual depressing the connect button 96 (FIGS. 8-11).

If the controller has been detected, the performance module identification and host product identification information is transmitted to the controller at block 186. Block 188 provides for determining whether one or more control signals have been received from the controller. If so, a drive profile is selected at block 190 based on the control signals, which are in turn based on user input and the performance module and host product identification information. Block 178 provides for controlling the performance module based on the selected drive profile. If no control signal has been received from the controller, or the performance module is being controlled based on received control signals, a determination is made at block 180 as to whether the ecosystem has changed. If not, the method 182 returns to the control signal check at block 188. If the ecosystem has changed, the method 182 returns to the determination at block 168.

Certain embodiments of the present application also provide for a controller (or "netswitch", "key", etc.) that is able to plan for and document virtually every aspect of a trip. In one embodiment the controller includes a performance unit that generates profile data for a performance module based on pre-trip data, wherein the profile data instructs a drive module to modify a performance characteristic of a host product in which the performance module is installed. The controller may also include a trip management unit, wherein the trip management unit collects sensor data from sensors based on the pre-trip data and generates post-trip data based on the sensor data.

Figure 14:
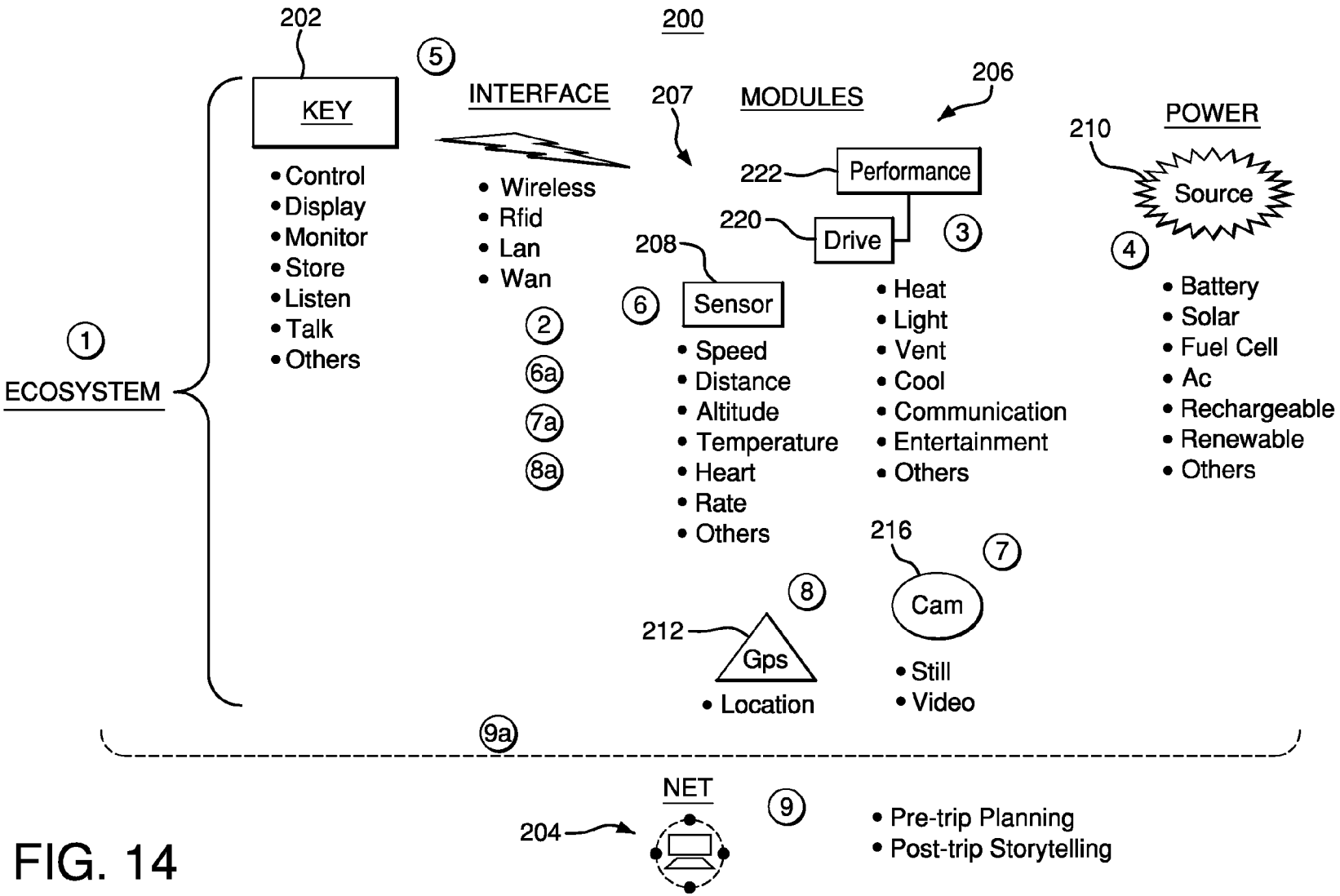
FIG. 14 is a diagram of an example of a trip management system according to an embodiment of the invention.

FIG. 14 shows an ecosystem 200 in which a key 202 is able to interact with one or more computing devices 204 such as personal computer (PCs), laptops, personal digital assistants (PDAs), etc., to exchange pre-trip data and post-trip data. The data exchanged can be used to assist the individual with navigation, inform the individual of his or her progress during and after the trip and control the performance characteristics of the gear being carried. The interface between the key 202 and the computing device 204 may be any suitable type of interface such as a wireless, RFID, USB, Ethernet, Bluetooth, local area network (LAN), wide area network (WAN), etc. The illustrated key 202 also communicates with various modules 207 such as performance management system modules 206 and sensing modules such as sensor 208, GPS receiver 212 and camera 216.

The sensor 208 could track and provide data related to speed, distance, altitude, temperature, heart rate, etc. For example, in the case of an altitude meter, the sensor 208 may include a wrist-mounted barometric altimeter. The sensor 208 may also function as a pedometer, accelerometer, gyroscope, compass, and so on. For example, in the case of a pedometer, the sensor 208 could be a portable electronic device worn on the belt that includes step counting circuitry, which counts each step the wearer makes. Such a pedometer may use a pendulum to sense hip movement and transfer the information to a readout display and/or other device. In the case of an accelerometer, a micro electro-mechanical system (MEMS) accelerometer could be incorporated into the sensor 208. The MEMS component of the accelerometer can include a suspended cantilever beam or proof mass (also known as seismic mass) with some type of deflection sensing and circuitry. Single axis, dual axis, and three axis MEMS-based accelerators may be used. If the sensor 208 includes gyroscope functionality, the gyroscope could operate based on the principle of conservation of angular momentum. The essence of the device may therefore be a spinning wheel on an axle, wherein the device, once spinning, tends to resist changes to its orientation due to the angular momentum of the wheel. In physics this phenomenon is also known as gyroscopic inertia or rigidity in space. The illustrated GPS receiver 212 provides data related to location wherein the location data is useful for navigation as well as trip documentation purposes. The camera 216 may communicate still and video data back to the key 202.

The performance management system modules 206 may include a drive module 220 and a performance module 222, which can provide for heating, lighting, ventilation, cooling, communication, entertainment, etc. with regard to a host product, as already discussed. The performance management system modules 206 may also make use of pre- and post-trip data to perform those tasks. For example, recommended gear lists is one type of pre-trip data that can be used to selected drive profiles for the performance module 222. The illustrated modules 207 are powered from a source 210, which may include battery, solar, fuel cell, AC, rechargeable, and/or renewable sources, as already discussed. The source 210 could also include a parasitic power generation component, which derives power from the user's own motions. The modules 207 may also communicate with the key 202 via a wide variety of interfaces such as wireless, RFID, LAN, WAN, and so on.

The illustrated key 202 therefore functions as a multi-functional link between the computing device 204 and the modules 207. In this regard, the illustrated key 202 is able to control and monitor the various features and functionality of the modules 207. For example, the key 202 could control the ventilation output of the performance module 222, as well as the image capturing features of the camera 216. Alternatively, the key 202 could merely accept photos from the camera 216. The key 202 could also collect altitude data from the sensor 208 and location data from the GPS receiver 212. Information transmitted to and received from the modules 207 may also be displayed on, monitored by and stored in the key 202. In addition, the key 202 may function as a traditional communications device (e.g., cell phone) to provide listening and talking functionality to the user.

Figure 15:
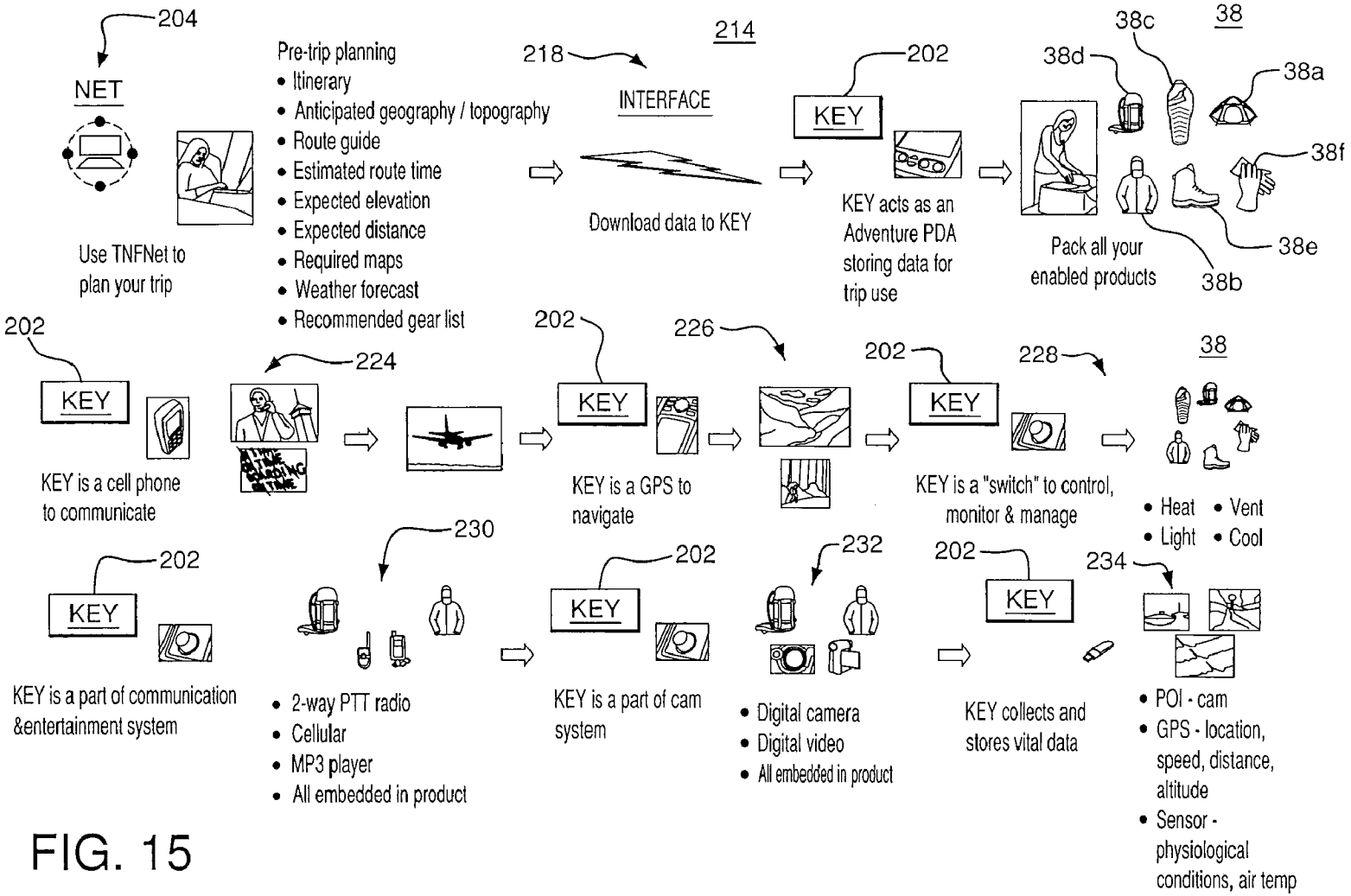
FIG. 15 is a flow diagram of an example of a trip management process according to an embodiment of the invention.

Turning now to FIG. 15, an example of a trip management process usage scenario 214 is shown. In this example, pre-trip data such as itinerary, anticipated geography/topography, route guide, estimated route time, expected elevation, expected distance, required maps, weather forecast and recommended gear lists is downloaded from the computing device 204 to the key 202 via an interface 218, wherein the key 202 may act as an "adventure" personal device assistant (PDA), storing data for trip use. Host products 38 (38*a*-38*f*) can then be packed and taken on the trip, wherein the modules 207 (FIG. 14) may be installed in the host products as appropriate. At trip stage 224, the key 202 is used by the individual as a cell phone to communicate.

Upon arrival at a new destination, the key 202 may be used to interface with the GPS receiver 212 (FIG. 14) to navigate during a stage 226 of the trip. At stage 228 of the trip, the key 202 may be used as a "netswitch" to control, monitor and manage performance management system modules installed in the host products 38 to achieve enhanced heat, lighting, ventilation and cooling performance for the host products 38. Trip stage 230 demonstrates that the key 202 may also be used as part of a communication and entertainment system to provide two-way push to talk (PTT) radio, cellular and MP2 player functionality, wherein the key 202 may be embedded in one of the host products 38. The key 202 may also be used to communicate with a camera module 216 (FIG. 14) at stage 232 of the trip. The scenario 214 further illustrates that the key 202 can be used to collect data from the modules 207 at stage 234. For example, the key 202 could collect point of interest (POI) data from the camera 216, GPS location data from the GPS receiver and speed, distance, altitude, physiological conditions, and air temperature from the other sensors.

Figure 16:
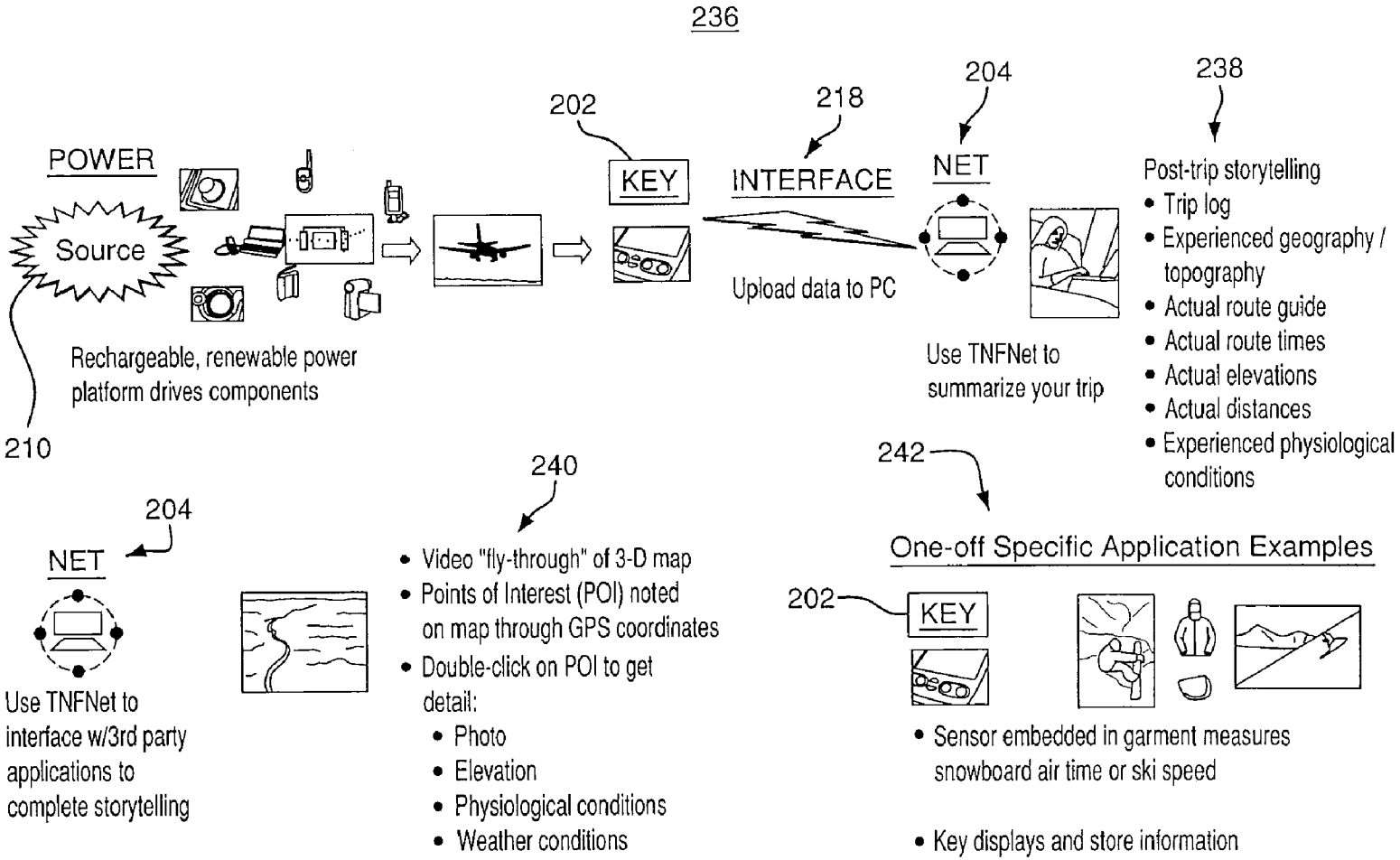
FIG. 16 is a flow diagram of an example of a post-trip management process according to an embodiment of the invention.

FIG. 16 illustrates a post-trip management process scenario 236 through which the various modules are powered by the source 210 and the key 202 is used to upload post-trip data to a computing device 204 via an interface 218. In the illustrated example, stage 238 of the trip involves post-trip storytelling such as generating and displaying trip logs, experienced geographies-topographies, actual route guides, actual route times, actual elevations, actual distances, experienced weather conditions and experienced physiological conditions. The computing device 204 may also be used to interface with third-party applications to enhance storytelling. For example, stage 240 of the trip could involve the use of video "fly-thoughs" of three-dimensional maps, and POIs noted on maps through GPS coordinates, wherein double-clicking on the POIs provides details such as photographs, elevation, physiological conditions, weather conditions, etc. Additional scenarios 242 illustrate specific application examples such as embedding a sensor in a garment to measure snowboard airtime or ski speed, wherein the key displays and stores this data.

Figure 17:
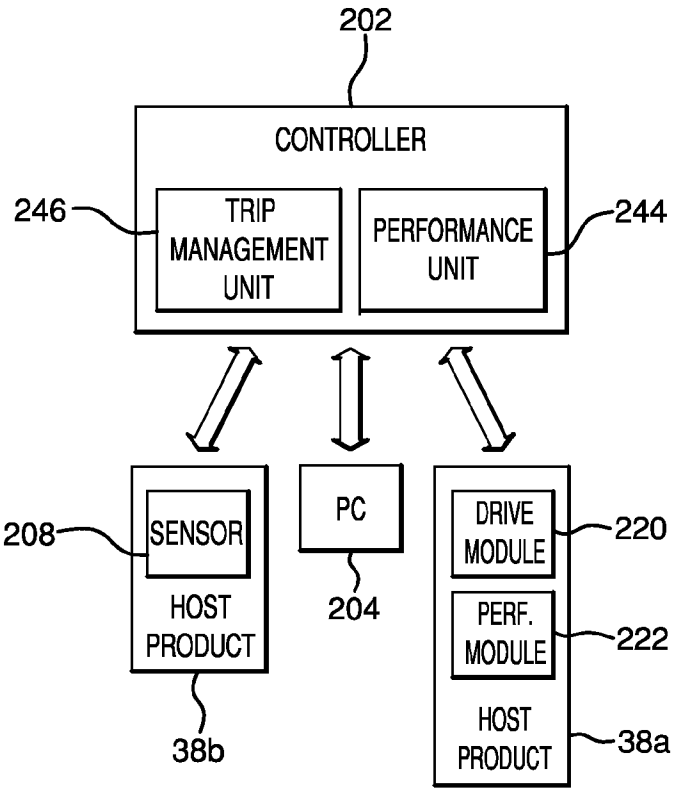
FIG. 17 is a block diagram of an example of a controller according to an embodiment of the invention.

Turning now to FIG. 17, one example of the controller/key 202 is shown in greater detail. In the illustrated example, the controller 202 has a performance unit 244 and a trip management unit 246, wherein the units 244, 246 enable the controller 202 to exchange information with the sensor 208, PC 204 and drive module 220, wherein the drive module 220 may be connected to a performance module 222 installed in a host product such as host product 38*a* and the sensor 208 may be installed in a host product such as host product 38*b*. Accordingly, the performance unit 244 may generate profile data for the performance module 222 based on pre-trip data, wherein the profile data instructs the drive module 220 to modify a performance characteristic of the host product 38*a*. In addition, the trip management unit 246 can collect sensor data from the sensor 208 based on the pre-trip data and generate post-trip data based on the sensor data.

Figure 18:
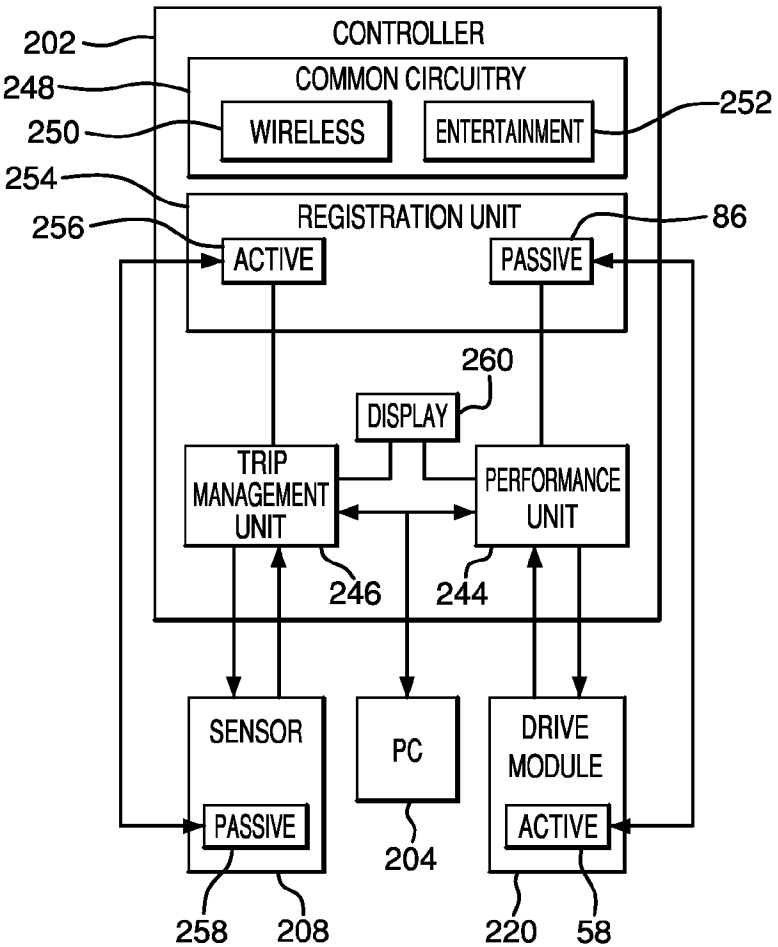
FIG. 18 is a more detailed block diagram of an example of a controller according to an embodiment of the invention.

FIG. 18 shows one example of the key/controller 202 in greater detail. In the illustrated example, the controller 202 has common circuitry 248 with a wireless component 250 and an entertainment component 252. The wireless component 250 may support communications functionality such as cellular functionality and PTT radio functionality, and the entertainment component 252 may support media functionality such as MP3 playback. The illustrated controller 202 also includes a registration unit 254 that is capable of managing links between the controller 202 and the sensor 208 and drive module 220. In the illustrated example, the registration unit 254 has a passive auto ID component 86, which communicates with an active auto ID component of the drive module 220 as already discussed. The registration unit 254 may also include an active auto ID component 256, that is able to communicate with a passive auto ID component of the sensor 208 to identify the sensor 208. In one embodiment, the active and passive auto ID components 256, 258 are RFID components. The illustrated controller 202 also includes a display 260 to communicate pre-trip data, post-trip data and sensor data to the user. The illustrated controller 202 may therefore keep track of multiple sensors and/or drive modules while closely monitoring and/or controlling their operation. The results can be communicated to the individual either directly from the controller 202 via the display 260, or indirectly via the PC 204.

The terms "connected", "coupled" and "attached" are used herein to refer to any type of relationship, direct or indirect, between the components in question, and may apply to electrical, mechanical, RF, optical or other couplings. In addition, the term "first", "second", and so on are used herein only to facilitate discussion, and do not necessarily infer any type of temporal or chronological relationship.

Those skilled in the art will appreciate from the foregoing description that the broad techniques of the embodiments of the present invention can be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, specifications, and following claim.

What is claimed is:

1. An outdoor gear performance management system comprising:

a host product having a plurality of performance characteristics associated therewith;

a first performance module connected to the host product that generates a first output to modify a first performance characteristic of the host product, wherein the first performance module is a fan whose output increases ventilation of the host product;

a second performance module connected to the host product that generates a second output to modify a second performance characteristic of the host product, wherein the second performance module is a light of which light output is used to illuminate the host product; and a drive module for controlling the performance modules based on respective first or second selected drive profile selected from a plurality of drive profiles, wherein the first selected drive profile modifies the first performance characteristic of the host product and the second selected drive profile modifies the second performance characteristic of the host product, wherein the first and second drive profiles are selected by the drive module based upon a type of output of a corresponding performance module and a type of host product, wherein the first and second performance modules may be used interchangeably between a variety of host products, wherein the host product is selected from the group consisting of jackets, gloves, hats, footwear, tents, sleeping bags, and backpacks, wherein the plurality of performance characteristics are selected from a group of parameters consisting of temperature, airflow, and illumination, and wherein the drive module is configured to sense and track parameters selected from the group consisting of body temperature, heart rate, hydration, motion, ambient temperature, compass/heading, weather forecast, GPS, altitude, distance, pace, calories burned, humidity, barometer pressure, and time.

2. The system of claim 1 further comprising a second host product having a plurality of performance characteristics associated therewith, the second host product includes third and fourth performance modules, and the drive module controls the third and fourth performance modules.

3. The system of claim 1 wherein the first drive profile, the second drive profile, or both is selected based upon user input.

4. The system of claim 1 wherein the first drive profile, the second drive profile, or both uses a current/voltage signature to operate the corresponding performance modules.

5. The system of claim 1 wherein the performance modules include a tether to provide an electrical connection to a connector.

6. The system of claim 1 wherein the drive module has a connector that interfaces with a connector of the performance modules.

7. The system of claim 6 wherein the drive module connector has a pin assigned to each type of performance module.

8. The system of claim 1 wherein the drive module is wirelessly connected to the performance modules.

9. The system of claim 1 wherein the drive module includes a power supply.

10. The system of claim 1 further comprising a controller to remotely control the drive module.

11. An outdoor gear performance management system comprising:

a host product having a plurality of performance characteristics associated therewith;

a first performance module connected to the host product that generates a first output to modify a first performance characteristic of the host product;

a second performance module connected to the host product that generates a second output to modify a second performance characteristic of the host product;

a drive module for controlling the performance modules based on respective first or second selected drive profile selected from a plurality of drive profiles, wherein the first selected drive profile modifies the first performance characteristic of the host product and the second selected drive profile modifies the second performance characteristic of the host product;

a controller including a performance unit to generate profile data for the performance modules based on pre-trip data, wherein the profile data instructs the drive module to modify the first and second performance characteristics of the host product; and a trip management unit to collect sensor data from a sensor based on the pre-trip data and generate post-trip data based on the sensor data, wherein the first and second drive profiles are selected by the drive module based upon a type of output of a corresponding performance module and a type of host product, wherein the first and second performance modules may be used interchangeably between a variety of host products, wherein the host product is selected from the group consisting of jackets, gloves, hats, footwear, tents, sleeping bags, and backpacks, wherein the plurality of performance characteristics are selected from a group of parameters consisting of temperature, airflow, and illumination, and wherein the drive module is configured to sense and track parameters selected from the group consisting of body temperature, heart rate, hydration, motion, ambient temperature, compass/heading, weather forecast, GPS, altitude, distance, pace, calories burned, humidity, barometer pressure, and time.

12. The system of claim 11 wherein the controller is configured to interact with one or more computing devices to exchange pre-trip and post-trip data.

13. The system of claim 12 wherein the controller functions as a multi-functional link between the one or more computing devices and the performance modules.

14. The system of claim 11 wherein the controller is wireless.

15. The system of claim 11 wherein the sensor tracks and provides data related to at least one of speed, distance, altitude, temperature, and heart rate.

16. The system of claim 11, further comprising a second host product having a plurality of performance characteristics associated therewith, the second host product includes third and fourth performance modules, and the drive module controls the third and fourth performance modules.

17. The system of claim 11, wherein the first drive profile, the second drive profile, or both is selected based upon user input.

18. The system of claim 11, wherein the first drive profile, the second drive profile, or both uses a current/voltage signature to operate the corresponding performance modules.

19. The system of claim 11, wherein the drive module is wirelessly connected to the performance modules.

20. The system of claim 11, wherein the drive module includes a power supply.

* * * * *